US009273549B2

(12) United States Patent
Walton et al.

(10) Patent No.: US 9,273,549 B2
(45) Date of Patent: Mar. 1, 2016

(54) SYSTEMS AND METHODS FOR REMOTE ACTUATION OF A DOWNHOLE TOOL

(71) Applicants: Zachary W. Walton, Duncan, OK (US); Andy Eis, Houston, TX (US); Matthew Todd Howell, Duncan, OK (US); Michael Fripp, Carrollton, TX (US)

(72) Inventors: Zachary W. Walton, Duncan, OK (US); Andy Eis, Houston, TX (US); Matthew Todd Howell, Duncan, OK (US); Michael Fripp, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 446 days.

(21) Appl. No.: 13/748,917

(22) Filed: Jan. 24, 2013

(65) Prior Publication Data

US 2014/0202689 A1 Jul. 24, 2014

(51) Int. Cl.

| | |
|---|---|
| ***E21B 47/10*** | (2012.01) |
| ***E21B 34/06*** | (2006.01) |
| *E21B 34/00* | (2006.01) |

(52) U.S. Cl.

CPC ..... *E21B 47/102* (2013.01); *E21B 34/06* (2013.01); *E21B 2034/007* (2013.01)

(58) Field of Classification Search

CPC ..... E21B 23/00; E21B 47/102; E21B 34/06

See application file for complete search history.

(56) References Cited

U.S. PATENT DOCUMENTS

| | | | | |
|---|---|---|---|---|
| 6,198,531 | B1 | 3/2001 | Myrick et al. | |
| 6,529,276 | B1 | 3/2003 | Myrick | |
| 2002/0074553 | A1* | 6/2002 | Starikov | H01L 31/108 257/77 |
| 2005/0178545 | A1* | 8/2005 | Evans et al. | 166/250.15 |
| 2010/0044041 | A1 | 2/2010 | Smith et al. | |
| 2010/0122813 | A1* | 5/2010 | Trummer et al. | 166/255.1 |
| 2010/0265509 | A1 | 10/2010 | Jones et al. | |
| 2011/0017458 | A1 | 1/2011 | East, Jr. et al. | |
| 2012/0150451 | A1 | 6/2012 | Skinner et al. | |
| 2013/0175094 | A1* | 7/2013 | Ross et al. | 175/57 |

FOREIGN PATENT DOCUMENTS

| | | | |
|---|---|---|---|
| WO | 2012010897 | A2 | 1/2012 |
| WO | 2012082248 | A1 | 6/2012 |
| WO | 2012141753 | A1 | 10/2012 |
| WO | 2014116442 | A1 | 7/2014 |

OTHER PUBLICATIONS

International Search Report and Written Opinion for PCT/US2014/011061 dated Apr. 30, 2014.

* cited by examiner

*Primary Examiner* — Robert E Fuller

(74) *Attorney, Agent, or Firm* — McDermott Will & Emery LLP; John W. Wustenberg

(57) ABSTRACT

Systems and methods for remote actuation of a downhole tool include a work string providing a flow path therein, a downhole tool coupled to the work string, at least one actuation device operatively coupled to the downhole tool and configured to act on the downhole tool such that the downhole tool performs a predetermined action, and an optical computing device communicably coupled to the at least one actuation device and configured to detect a characteristic of a substance in the flow path and trigger actuation of the at least actuation device when the characteristic is detected.

26 Claims, 3 Drawing Sheets

SYSTEMS AND METHODS FOR REMOTE ACTUATION OF A DOWNHOLE TOOL

BACKGROUND

The present disclosure relates generally to wellbore operations and, more particularly, to systems and methods for remote actuation of a downhole tool.

Hydrocarbon-producing wells are often stimulated by hydraulic fracturing operations in order to enhance the production of hydrocarbons present in subterranean formations. During a typical fracturing operation, a servicing fluid (i.e., a fracturing fluid or a perforating fluid) may be injected into a subterranean formation penetrated by a wellbore at a hydraulic pressure sufficient to create or enhance fractures within the subterranean formation. The resulting fractures serve to increase the conductivity potential for extracting hydrocarbons from the subterranean formation.

In some wellbores, it may be desirable to selectively generate multiple fractures along the wellbore at predetermined distances apart from each other, thereby creating multiple "pay zones" in the subterranean formation. Some pay zones may extend a substantial distance along the axial length of the wellbore. In order to adequately fracture the subterranean formation encompassing such zones, it may be advantageous to introduce a stimulation fluid via multiple stimulation assemblies arranged within the wellbore at spaced apart locations on a work string extended therein. Each stimulation assembly may include, for example, a sliding sleeve configured to be opened and shut in order to allow fluid communication between the interior of the work string and the surrounding subterranean formation.

In some applications, the sleeve may be opened or otherwise actuated by introducing a ball or dart into the work string which engages an internal baffle or seat defined on the interior surface of the work string. Once the ball is properly seated on its corresponding internal baffle, the work string is pressurized and the increased pressure serves to actuate the sleeve via a variety of mechanical or hydraulic means. While effective in opening the sleeve, the ball must be retrieved from the work string or otherwise drilled out in order to introduce other downhole tools or assemblies past that point in the work string. Moreover, the interior baffles that seat the ball necessarily reduce the inner diameter of the work string, thereby reducing the size of tools and devices that may be extended past that point in the work string.

In other applications, the sleeve may be actuated using one or more downhole electromechanical or hydromechanical devices configured to receive a command signal from the surface when actuation is required. Providing command signals to downhole electronic equipment, however, can be problematic for a number of reasons. Electrical signal wires running down the wellbore may become cut by abrasion or twisted and broken during run-in. Also, the ambient downhole environment may interfere with reception of acoustic or electromagnetic signals sent from the surface and, in addition, signal attenuation for a deep well may reduce the strength of an acoustic signal below a reception threshold of the equipment even in the absence of interference.

While there are several methods of actuating downhole tools, such as sliding sleeve assemblies, it nonetheless remains advantageous to find new and improved methods of actuating downhole tools that will reduce costs and increase hydrocarbon extraction efficiency.

SUMMARY OF THE DISCLOSURE

The present disclosure relates generally to wellbore operations and, more particularly, to systems and methods for remote actuation of a downhole tool.

In some embodiments, a well system is disclosed and may include a work string providing a flow path therein, a downhole tool coupled to the work string, at least one actuation device operatively coupled to the downhole tool and configured to act on the downhole tool such that the downhole tool performs a predetermined action, and an optical computing device communicably coupled to the at least one actuation device and configured to detect a characteristic of a substance in the flow path and trigger actuation of the at least actuation device based on detecting the characteristic.

In other embodiments, a method of remotely actuating a downhole tool is disclosed. The method may include conveying a substance into a flow path defined in a work string, the downhole tool being coupled to the work string, monitoring the flow path with an optical computing device configured to detect a characteristic of the substance, transmitting a command signal to at least one actuation device with the optical computing device based on detection of the characteristic of the substance, the at least one actuation device being operatively coupled to the downhole tool, and acting on the downhole tool with the at least one actuation device in response to the command signal such that the downhole tool performs a predetermined action.

In yet other embodiments, another a well system may be disclosed and may include a work string providing a flow path therein, a sliding sleeve assembly coupled to the work string and having a body with a sleeve movably arranged therein between an open configuration, where fluid communication is allowed between an interior of the body and an exterior of the work string, and a closed configuration, where fluid communication is prevented between the interior of the body and the exterior of the work string, an actuation device operatively coupled to the sliding sleeve assembly and configured to move the sleeve between the open and closed configurations, and an optical computing device communicably coupled to the actuation device and configured to detect a characteristic of a substance in the flow path and trigger actuation of the actuation device based on detecting the characteristic.

In yet other embodiments, another method of remotely actuating a sliding sleeve assembly may be disclosed. The method may include conveying a substance into a flow path defined in a work string, the sliding sleeve assembly being coupled to the work string and having a body with a sleeve movably arranged therein, monitoring the flow path with an optical computing device configured to detect a characteristic of the substance, transmitting a command signal to an actuation device from the optical computing device based on detection of the characteristic of the substance, the at least one actuation device being operatively coupled to the sliding sleeve assembly, and moving the sleeve with the actuation device in response to the command signal.

The features of the present disclosure will be readily apparent to those skilled in the art upon a reading of the description of the preferred embodiments that follows.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, as will occur to those skilled in the art and having the benefit of this disclosure.

DETAILED DESCRIPTION

The present disclosure relates generally to wellbore operations and, more particularly, to systems and methods for remote actuation of a downhole tool.

The systems and methods disclosed herein allow for the remote actuation of a downhole tool using one or more optical computing devices. The optical computing devices may be configured to monitor a flow path (e.g., the inside of a work string) for one or more substances or particular characteristics of the one or more substances as they are conveyed within the work string, such as downhole from the surface. When a particular substance or characteristic is detected, the optical computing device may be configured to send a command signal to an actuation device which acts on or otherwise actuates or activates a corresponding downhole tool to perform a predetermined action. In some embodiments, the downhole tool may be a sliding sleeve assembly, and the optical computing device may direct the actuation device to open or close a sleeve within the sliding sleeve assembly when a particular substance or characteristic of interest is detected. In other embodiments, the downhole tool may be any other type of downhole tool known to those skilled in the art, and the optical computing device may be configured to trigger the actuation of such devices through the detection of a predetermined substance or characteristic of interest.

Figure 1:
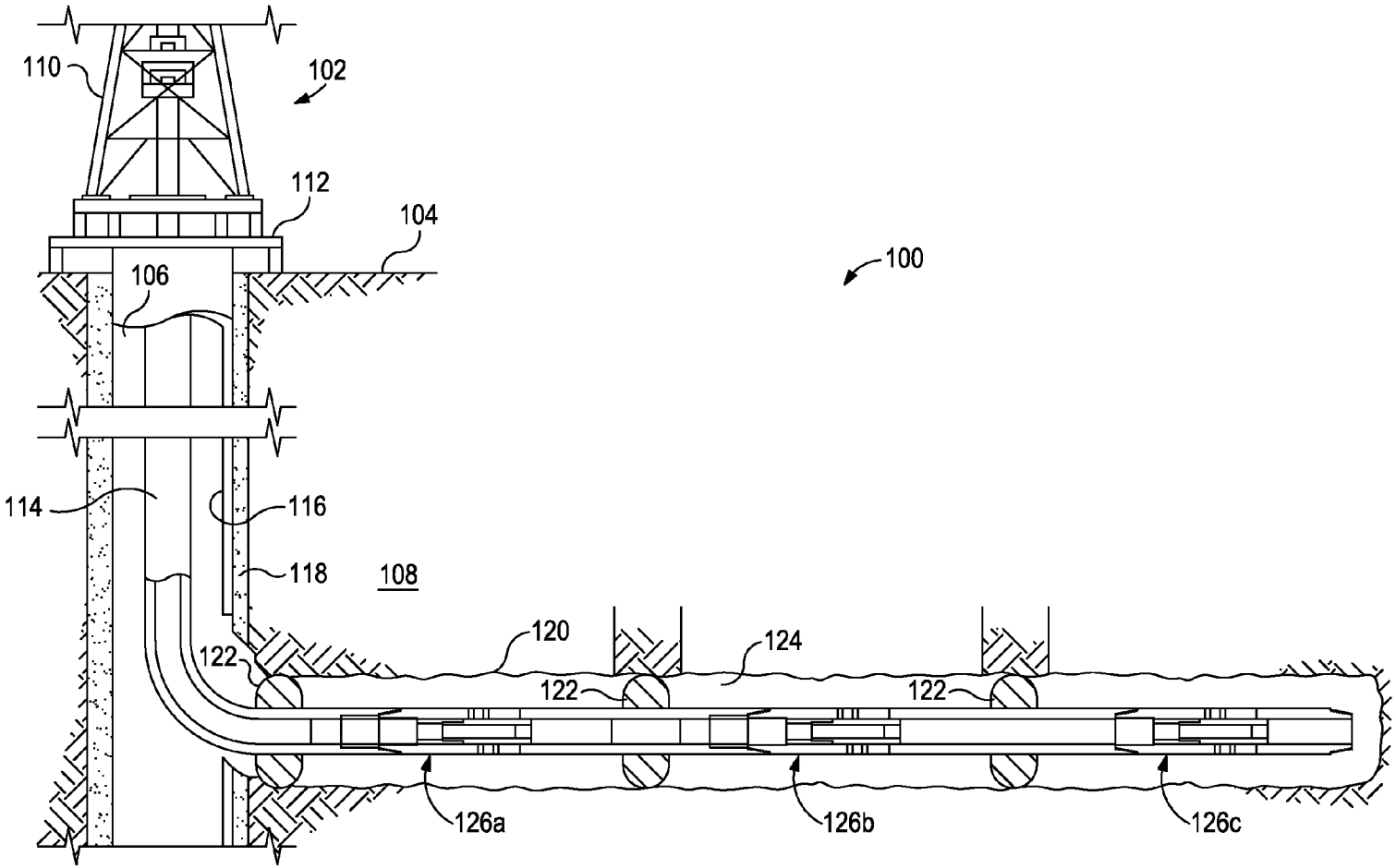
FIG. 1 is a schematic of an exemplary well system which can embody or otherwise employ one or more principles of the present disclosure, according to one or more embodiments.

Referring to FIG. 1, illustrated is an exemplary well system 100 which can embody or otherwise employ one or more principles of the present disclosure, according to one or more embodiments. As illustrated, the well system 100 may include an oil and gas rig 102 arranged at the Earth's surface 104 and a wellbore 106 extending therefrom and penetrating a subterranean earth formation 108. It should be noted that, even though FIG. 1 depicts a land-based oil and gas rig 102, it will be appreciated that the embodiments of the present disclosure are equally well suited for use in other types of rigs, such as offshore platforms, or rigs used in any other geographical location.

The rig 102 may include a derrick 110 and a rig floor 112, and the derrick 110 may support or otherwise help manipulate the axial position of a work string 114 extended within the wellbore 106 from the rig floor 112. As used herein, the term "work string" refers to one or more types of connected lengths of tubulars as known in the art, and may include, but is not limited to, drill pipe, drill string, landing string, production tubing, combinations thereof, or the like. In other embodiments, the work string 114 may be or otherwise represent any other downhole conveyance means known to those skilled in the art such as, but not limited to, coiled tubing, wireline, slickline, and the like, without departing from the scope of the disclosure. In exemplary operation, the work string 114 may be utilized in drilling, stimulating, completing, or otherwise servicing the wellbore 106, or various combinations thereof.

As illustrated, the wellbore 106 may extend substantially vertically away from the surface 104 over a vertical wellbore portion. In other embodiments, the wellbore 106 may otherwise deviate at any angle from the surface 104 over a deviated or horizontal wellbore portion. In other applications, portions or substantially all of the wellbore 106 may be vertical, deviated, horizontal, and/or curved. Moreover, use of directional terms such as above, below, upper, lower, upward, downward, uphole, downhole, and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe or bottom of the well.

In an embodiment, the wellbore 106 may be at least partially cased with a casing string 116 or may otherwise remain at least partially uncased. The casing string 116 may be secured into position within the wellbore 106 using, for example, cement 118. In other embodiments, the casing string 116 may be only partially cemented within the wellbore 106 or, alternatively, the casing string 116 may be entirely uncemented. A lower portion of the work string 114 may extend into a branch or lateral portion 120 of the wellbore 106. As illustrated, the lateral portion 120 may be an uncased or "open hole" section of the wellbore 106. It is noted that although FIG. 1 depicts horizontal and vertical portions of the wellbore 106, the principles of the apparatuses, systems, and methods disclosed herein may be similarly applicable to or otherwise suitable for use in wholly horizontal or vertical wellbore configurations. Consequently, the horizontal or vertical nature of the wellbore 106 should not be construed as limiting the present disclosure to any particular wellbore 106 configuration.

The work string 114 may be arranged or otherwise seated within the lateral portion 120 of the wellbore 106 using one or more packers 122 or other wellbore isolation devices known to those skilled in the art. The packers 122 may be configured to seal off an annulus 124 defined between the work string 114 and the walls of the wellbore 106. As a result, the subterranean formation 108 may be effectively divided into multiple intervals or "pay zones" which may be stimulated and/or produced independently via isolated portions of the annulus 124 defined between adjacent pairs of packers 122. While only three pay zones are shown in FIG. 1, those skilled in the art will readily recognize that any number of pay zones may be used in the well system 100, without departing from the scope of the disclosure.

The well system 100 may further include one or more downhole tools 126 (shown as 126*a*, 126*b*, and 126*c*) arranged in, coupled to, or otherwise forming an integral part of the work string 116. As illustrated, at least one downhole tool 126 may be arranged in the work string 116 in each pay zone, but those skilled in the art will readily appreciate that more than one downhole tool 126 may be arranged therein, without departing from the scope of the disclosure. The downhole tool 126 may include a variety of tools, devices, or machines known to those skilled in the art that may be used in the preparation, stimulation, and production of the subterranean formation 108. In at least one embodiment, the downhole tool 126 in each pay zone may include or otherwise be a sliding sleeve assembly that may be actuatable in order to provide fluid communication between the annulus 124 and the interior of the work string 114. In other embodiments, however, the downhole tool 126 may include, but is not limited to, a sampling device, a wellbore packer or other wellbore device, setting tools, one or more valves, one or more flow restrictors (e.g., flow control devices, inflow control devices, etc.), a fluid sampler, one or more sensors, a telemetry device, a monitoring device, drilling/reaming devices or other well intervention devices, fishing tools, wellbore cleaning devices, injection and cutting devices, conveyance devices, material or fluid delivery devices, logging tools, measuring tools, artificial lifting device, connectors, and any downhole device or mechanism that may require activation.

Figure 2A:
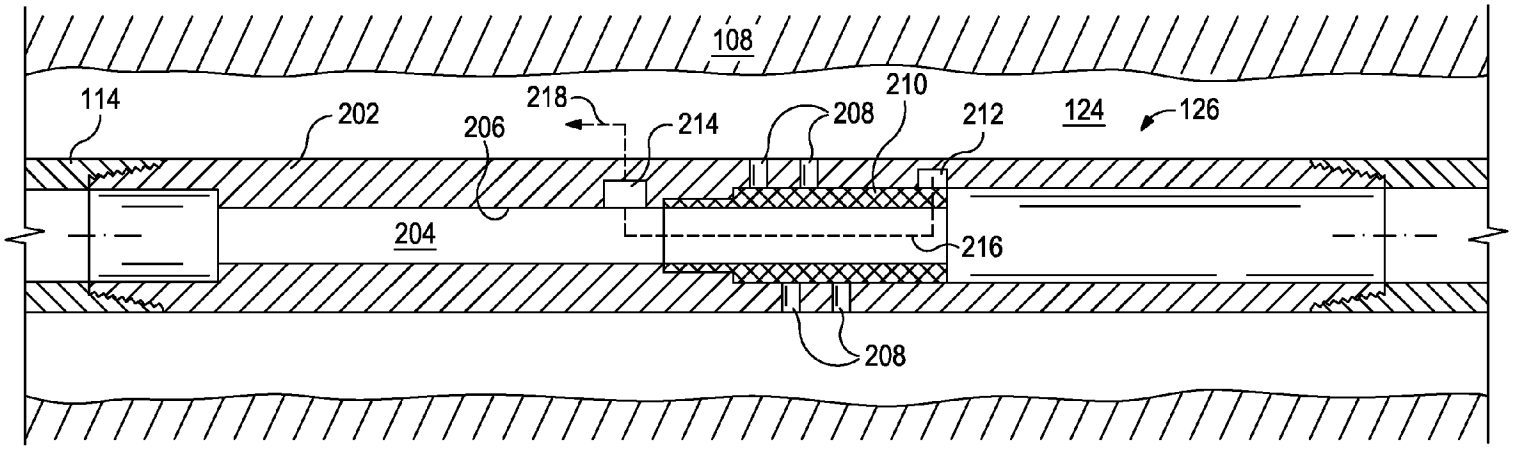
FIGS. 2A and 2B are enlarged cross-sectional views of an exemplary downhole tool, according to one or more embodiments.
Figure 2B:
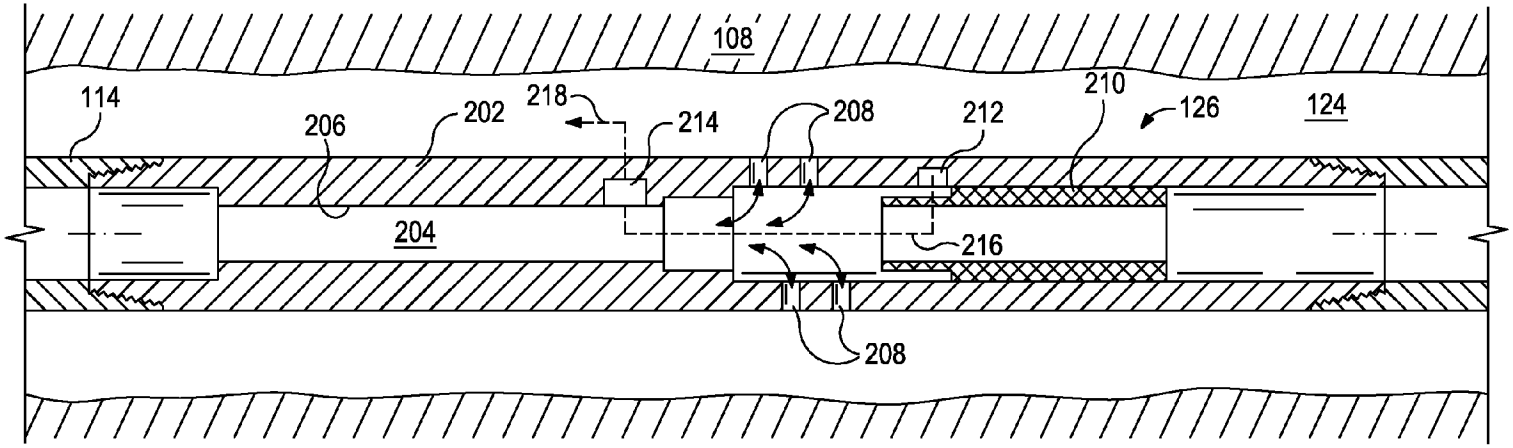

Referring to FIGS. 2A and 2B, with continued reference to FIG. 1, illustrated are enlarged cross-sectional views of the exemplary downhole tool 126, according to one or more embodiments. Again, as illustrated, the downhole tool 126 may be or otherwise encompass a sliding sleeve assembly, as generally known in the art, but may equally be any other actuatable downhole tool listed above, without departing from the scope of the disclosure. In the illustrated embodiment, the downhole tool 126 may include an elongate body 202 that may be threaded or otherwise coupled to the work string 114 at opposing ends thereof. The body 202 may define a central passageway in its interior 206 such that a flow path 204 is provided that fluidly connects the work string 114 to the downhole tool 126.

The body 202 may also define one or more flow ports 208 configured to provide fluid communication between the annulus 124 and the interior 206. In some embodiments, the flow ports 208 may be fitted with one or more flow control devices (e.g., nozzles, inflow control devices, erodible nozzles, etc.). In other embodiments, the flow ports 208 may be fitted with one or more plugs, screens, covers, or shields, for example, to prevent debris from entering the interior 206 of the work string 114.

A sleeve 210 may be movably arranged within the interior 206 between open and closed configurations. For example, the sleeve 210 is depicted in FIG. 2A in a closed configuration where the sleeve 210 is positioned to generally occlude the flow ports 208 and thereby prevent fluid communication between the annulus 124 and the interior 206 of the work string 114. FIG. 2B, however, depicts the sleeve 210 in an open configuration where the sleeve 210 has been axially moved within the interior 206 such that the flow ports 208 are exposed and fluid communication between the annulus 124 and the interior 206 is thereby allowed or otherwise facilitated. With the sleeve 210 in the open configuration, various fracturing or stimulation fluids may be discharged from the work string 114 or downhole tool 126 via the flow ports 208 in order to stimulate the surrounding formation 108. Alternatively, with the sleeve 210 in the open configuration, fluids derived from the formation 108 and annulus 124 may be drawn into the work string 114 via the flow ports 208 and produced to the surface 104 (FIG. 1) for processing.

In one or more embodiments, the well system 100 may further include at least one actuation device 212 operatively coupled to or otherwise forming an integral part of the downhole tool 126. The actuation device 212 may be any type of downhole device configured to act on an exemplary downhole tool such that the particular downhole tool performs a predetermined action. In some embodiments, the actuation device 212 may be configured to trigger the predetermined action of the downhole tool. In other embodiments, however, the actuation device 212 may be configured to carry out or otherwise facilitate the predetermined action. In the illustrated embodiment, for example, the predetermined action of the downhole tool 126 may be to axially move the sleeve 210 within the interior 206 of the body 202 between the open and closed configurations. To accomplish this, the actuation device 212 may be operatively coupled to the sleeve 210 and, when triggered, may be configured to act on the sleeve 210 such that it translates axially within the interior 206 between the open and closed configurations.

Those skilled in the art will readily appreciate the several predetermined actions that different downhole tools may be configured to perform in conjunction with the actuation device 212. Exemplary predetermined actions may include, but are not limited to, changing a flow restriction, sampling a fluid, starting, stopping, or adjusting sensor sampling, starting, stopping, or adjusting telemetry communication, opening or closing a flow path, applying compression, tension, or torsional forces, deploying components to engage the wellbore or formation, initiating further downhole calculations for subsequent actions or reprogramming of devices for existing conditions, activating another electronic device, and any combination thereof.

The actuation device 212 may include, but is not limited to an electromechanical actuation device such as an electromechanical actuator, a mechanical actuator, a hydraulic actuator, a pneumatic actuator, a piezoelectric actuator, a solenoid, combinations thereof, and the like. In other embodiments, the actuation device 212 may be a motor powered using electrical power, hydraulic fluid pressure, pneumatic pressure, combinations thereof, and the like. In some embodiments, the actuation device 212 may be configured to trigger a frangible device or a chemical actuator (e.g., a thermite reaction that causes the mechanical failure of a component). In at least one embodiment, the actuation device 212 may be an electronic rupture disc as described generally in U.S. patent Ser. Nos. 12/688,058 and 13/219,790, the contents of which are hereby incorporated by reference in their entirety.

In one or more embodiments, the well system 100 may further include an optical computing device 214 arranged within the flow path 204 or otherwise in optical communication with the flow path 204. In exemplary operation, the optical computing device 214 may be configured to monitor the flow path 204 of the work string 114 or the downhole tool 126 and determine or otherwise detect one or more particular characteristics of a substance that may be present therein. In some embodiments, for example, the optical computing device 214 may be configured to monitor one or more characteristics of a fluid flowing within the flow path 204. The fluid may be strategically introduced into the flow path 204 from the surface 104 (FIG. 1). In other embodiments, however, the fluid may be introduced into the flow path 204 at other locations along the work string 114 such as, but not limited to, the surrounding formation 108, other pay zones along the work string 114, another type of downhole delivery mechanism, etc., without departing from the scope of the disclosure.

In yet other embodiments, the optical computing device 214 may be configured to monitor one or more characteristics of a wellbore intervention device or projectile introduced into the work string 114 from the surface and conveyed to the downhole tool 126. Exemplary wellbore projectiles include, but are not limited to, balls, darts, and plugs (e.g., wiper plugs, cementing plugs, etc.). In some embodiments, the wellbore projectile may be connected to the surface by a wireline, slickline, electric line, coiled tubing, or jointed tubing.

While the optical computing device 214 is shown in FIGS. 2A and 2B as being arranged within or otherwise coupled to the downhole tool 126, those skilled in the art will readily appreciate that the optical computing device 214 may equally be arranged on or otherwise coupled to the work string 114, without departing from the scope of the disclosure. Indeed, the optical computing device 214 may be arranged at any suitable location along the flow path 204 in order to properly monitor the flow path 204.

As mentioned above, the optical computing device 214 may be configured to detect one or more characteristics of interest of a substance within the flow path 204. Once the optical computing device 214 detects the particular characteristic of interest, it may be configured to send a command signal to the actuation device 212 in order to trigger the predetermined action of the downhole tool 126. As illustrated, the optical computing device 214 may be communicably coupled to the actuation device 212 via one or more communication lines 216. The communication line 216 may be any wired or wireless means of telecommunication between two locations and may include, but is not limited to, electrical lines, fiber optic lines, radio frequency transmission, electromagnetic telemetry, or any other type of telecommunication means known to those skilled in the art. In the illustrated embodiment, once the optical computing device 214 detects the particular characteristic of interest, a command signal is conveyed to the actuation device 212 via the communication line 216 in order to trigger actuation of the actuation device 212 and thereby axially move the sleeve 210 between the open and closed configurations.

The optical computing device 214 may also be configured to communicate with the surface 104 (FIG. 1) via one or more communication lines 218. Similar to the communication line 216, the communication line 218 may be any wired or wireless means of telecommunication between two locations and may include, but is not limited to, electrical lines, fiber optic lines, radio frequency transmission, electromagnetic telemetry, acoustic telemetry, or any other type of telecommunication means known to those skilled in the art. In some embodiments, the communication line 218 may be bi-directional, thereby allowing an operator at the surface 104 to send command signals downhole to the various downhole tools 126. Accordingly, an operator at the surface 104 may be apprised, in real-time, of the particular operations of the downhole tools 126 and may react accordingly by communicating additional command signals downhole.

A description of the exemplary optical computing device 214 and its exemplary operation is now provided. As used herein, the term "optical computing device" refers to an optical device that is configured to receive an input of electromagnetic radiation associated with a substance (e.g., a fluid) and produce an output of electromagnetic radiation from a processing element arranged within the optical computing device. The processing element may be, for example, an integrated computational element (ICE) used in the optical computing device. The electromagnetic radiation that optically interacts with the processing element is changed so as to be readable by a detector, such that an output of the detector can be correlated to a characteristic of the substance. The output of electromagnetic radiation from the processing element can be reflected electromagnetic radiation, transmitted electromagnetic radiation, and/or dispersed electromagnetic radiation. In addition, emission and/or scattering of the fluid or a phase thereof, for example via fluorescence, luminescence, Raman, Mie, and/or Raleigh scattering, can also be monitored by the optical computing devices.

As used herein, the term "fluid" refers to any substance that is capable of flowing, including particulate solids, liquids, gases, slurries, emulsions, powders, muds, glasses, mixtures, combinations thereof, and the like. The fluid may be a single phase or a multiphase fluid. In some embodiments, the fluid can be an aqueous fluid, including water, brines, or the like. In other embodiments, the fluid may be a non-aqueous fluid, including organic compounds, more specifically, hydrocarbons, oil, a refined component of oil, petrochemical products, and the like. In some embodiments, the fluid can be acids, surfactants, biocides, bleaches, corrosion inhibitors, foamers and foaming agents, breakers, scavengers, stabilizers, clarifiers, detergents, a treatment fluid, fracturing fluid, a formation fluid, or any oilfield fluid, chemical, or substance as found in the oil and gas industry and generally known to those skilled in the art. The fluid may also have one or more solids or solid particulate substances entrained therein. For instance, fluids can include various flowable mixtures of solids, liquids and/or gases. Illustrative gases that can be considered fluids according to the present embodiments, include, for example, air, nitrogen, carbon dioxide, argon, helium, methane, ethane, butane, and other hydrocarbon gases, hydrogen sulfide, combinations thereof, and/or the like.

As used herein, the term "characteristic" refers to a chemical, mechanical, or physical property of a substance, such as a fluid or an object flowing in or with the fluid. A characteristic may also refer to a chemical, mechanical, or physical property of a phase of a substance or fluid. Illustrative characteristics of a substance and/or a phase of the substance that can be detected or otherwise monitored with the optical computing devices disclosed herein can include, for example, chemical composition (e.g., identity and concentration in total or of individual components), phase presence, impurity content, pH, viscosity, density, ionic strength, total dissolved solids, salt content, porosity, opacity, bacteria content, combinations thereof, color, state of matter (solid, liquid, gas, emulsion, mixtures, etc.), and the like. Exemplary characteristics of a phase of substance, such as a fluid, can include a volumetric flow rate of the phase, a mass flow rate of the phase, or other properties of the phase derivable from the volumetric and/or mass flow rate. Such properties can be determined for each phase detected in the substance or fluid. Moreover, the phrase "characteristic of interest of/in a fluid" may be used herein to refer to the characteristic of a substance or a phase of the substance contained in or otherwise flowing with the fluid.

As used herein, the term "flow path" refers to a route through which a fluid or an object present in the fluid is capable of being transported between two points. In some cases, the flow path need not be continuous or otherwise contiguous between the two points. Exemplary flow paths include, but are not limited to, a flowline, a pipeline, a production tubular or tubing, an annulus defined between a wellbore and a pipeline, a hose, a process facility, a storage vessel, a tanker, a railway tank car, a transport ship or vessel, a subterranean formation, combinations thereof, or the like. In cases where the flow path is a pipeline, or the like, the pipeline may be a pre-commissioned pipeline or an operational pipeline. In other cases, the flow path may be created or generated via movement of an optical computing device through a fluid (e.g., an open air sensor). In yet other cases, the flow path is not necessarily contained within any rigid structure, but refers to the path fluid takes between two points, such as where a fluid flows from one location to another without being contained, per se. It should be noted that the term "flow path" does not necessarily imply that a fluid is flowing therein, rather that a fluid is capable of being transported or otherwise flowable therethrough.

As used herein, the term "electromagnetic radiation" refers to radio waves, microwave radiation, infrared and near-infrared radiation, visible light, ultraviolet light, X-ray radiation and gamma ray radiation.

As used herein, the term "optically interact" or variations thereof refers to the reflection, transmission, scattering, diffraction, or absorption of electromagnetic radiation either on, through, or from one or more processing elements (i.e., integrated computational elements), a fluid, or a phase of the fluid. Accordingly, optically interacted light refers to electromagnetic radiation that has been reflected, transmitted, scattered, diffracted, or absorbed by, emitted, or re-radiated, for example, using an integrated computational element, but may also apply to interaction with a fluid or a phase of the fluid.

As used herein, the term "substance," or variations thereof, refers to at least a portion of matter or material of interest to be tested or otherwise evaluated using the optical computing devices described herein. The substance includes the characteristic of interest, as defined above, and may be any fluid, as defined herein, or otherwise any solid substance or material such as, but not limited to, rock formations, concrete, solid wellbore surfaces, and solid surfaces of any wellbore tool or projectile (e.g., balls, darts, plugs, etc.).

Figure 3:
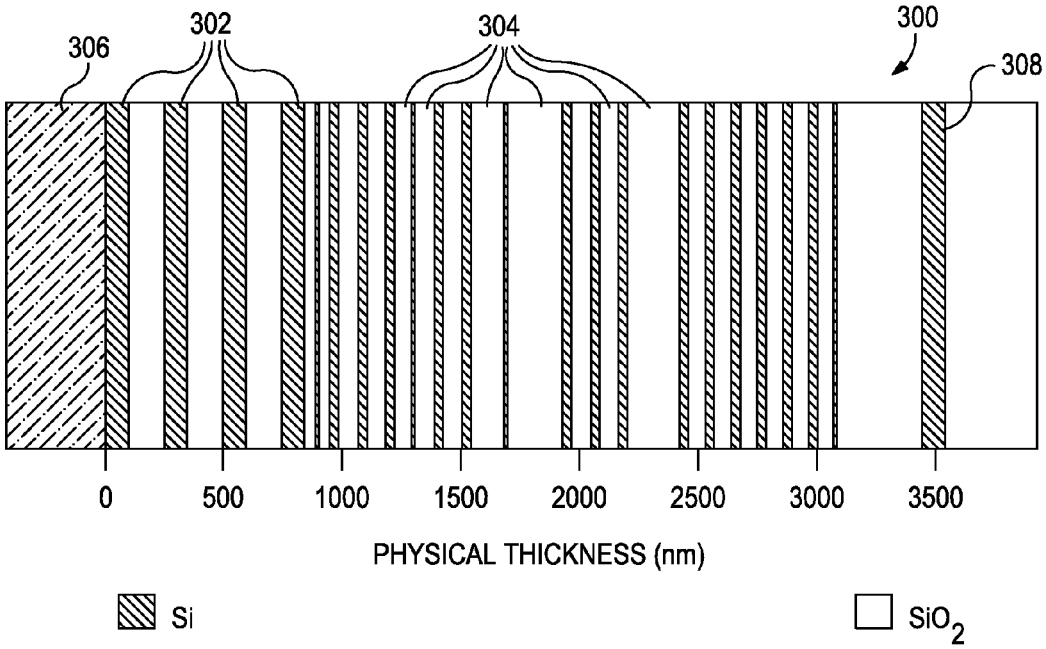
FIG. 3 illustrates an exemplary integrated computation element, according to one or more embodiments.

As mentioned above, the processing element used in the exemplary optical computing device 214 may be an integrated computational element (ICE). In operation, an ICE component is capable of distinguishing electromagnetic radiation related to a characteristic of interest of a substance (e.g., a fluid or an object present in the fluid) from electromagnetic radiation related to other components of the substance. Referring to FIG. 3, illustrated is an exemplary ICE 300, according to one or more embodiments. As illustrated, the ICE 300 may include a plurality of alternating layers 302 and 304, such as silicon (Si) and $SiO_2$ (quartz), respectively. In general, these layers 302, 304 consist of materials whose index of refraction is high and low, respectively. Other examples of materials might include niobia and niobium, germanium and germania, MgF, SiO, and other high and low index materials known in the art. The layers 302, 304 may be strategically deposited on an optical substrate 306. In some embodiments, the optical substrate 306 is BK-7 optical glass. In other embodiments, the optical substrate 306 may be another type of optical substrate, such as quartz, sapphire, silicon, germanium, zinc selenide, zinc sulfide, or various plastics such as polycarbonate, polymethylmethacrylate (PMMA), polyvinylchloride (PVC), diamond, ceramics, combinations thereof, and the like.

At the opposite end (e.g., opposite the optical substrate 306 in FIG. 3), the ICE 300 may include a layer 308 that is generally exposed to the environment of the device or installation. The number of layers 302, 304 and the thickness of each layer 302, 304 are determined from the spectral attributes acquired from a spectroscopic analysis of a characteristic of the substance being analyzed using a conventional spectroscopic instrument. It should be understood that the exemplary ICE 300 in FIG. 3 does not in fact represent any particular characteristic of a given substance, but is provided for purposes of illustration only. Consequently, the number of layers 302, 304 and their relative thicknesses, as shown in FIG. 3, bear no correlation to any particular characteristic. Moreover, those skilled in the art will readily recognize that the materials that make up each layer 302, 304 (i.e., Si and $SiO_2$) may vary, depending on the application, cost of materials, and/or applicability of the material to the given substance being analyzed.

In some embodiments, the material of each layer 302, 304 can be doped or two or more materials can be combined in a manner to achieve the desired optical characteristic. In addition to solids, the exemplary ICE 300 may also contain liquids and/or gases, optionally in combination with solids, in order to produce a desired optical characteristic. In the case of gases and liquids, the ICE 300 can contain a corresponding vessel (not shown), which houses the gases or liquids. Exemplary variations of the ICE 300 may also include holographic optical elements, gratings, piezoelectric, light pipe, and/or acousto-optic elements, for example, that can create transmission, reflection, and/or absorptive properties of interest.

The multiple layers 302, 304 exhibit different refractive indices. By properly selecting the materials of the layers 302, 304 and their relative thickness and spacing, the ICE 300 may be configured to selectively pass/reflect/refract predetermined fractions of electromagnetic radiation at different wavelengths. Each wavelength is given a predetermined weighting or loading factor. The thickness and spacing of the layers 302, 304 may be determined using a variety of approximation methods from the spectrum of the characteristic or analyte of interest. These methods may include inverse Fourier transform (IFT) of the optical transmission spectrum and structuring the ICE 300 as the physical representation of the IFT. The approximations convert the IFT into a structure based on known materials with constant refractive indices. Further information regarding the structures and design of exemplary ICE elements is provided in *Applied Optics*, Vol. 35, pp. 5484-5492 (1996) and Vol. 29, pp. 2876-2893 (1990), which are hereby incorporated by reference.

The weightings that the layers 302, 304 of the ICE 300 apply at each wavelength are set to the regression weightings described with respect to a known equation, or data, or spectral signature. When electromagnetic radiation interacts with a substance, unique physical and chemical information about the substance may be encoded in the electromagnetic radiation that is reflected from, transmitted through, or radiated from the substance. This information is often referred to as the spectral "fingerprint" of the substance. The ICE 300 may be configured to perform the dot product of the electromagnetic radiation received by the ICE 300 and the wavelength dependent transmission function of the ICE 300. The wavelength dependent transmission function of the ICE is dependent on the layer material refractive index, the number of layers 302, 304 and the layer thicknesses. The ICE 300 transmission function is then analogous to a desired regression vector derived from the solution to a linear multivariate problem targeting a specific component of the sample being analyzed. As a result, the output light intensity of the ICE 300 is related to the characteristic or analyte of interest.

The optical computing devices employing such an ICE may be capable of extracting the information of the spectral fingerprint of multiple characteristics or analytes within a substance and converting that information into a detectable output regarding the overall properties of the substance. That is, through suitable configurations of the optical computing devices, electromagnetic radiation associated with characteristics or analytes of interest in a substance can be separated from electromagnetic radiation associated with all other components of the substance in order to estimate the properties of the substance in real-time or near real-time. Further details regarding how the exemplary ICE 300 is able to distinguish and process electromagnetic radiation related to the characteristic or analyte of interest are described in U.S. Pat. Nos. 6,198,531; 6,529,276; and 7,920,258, incorporated herein by reference in their entirety.

Figure 4:
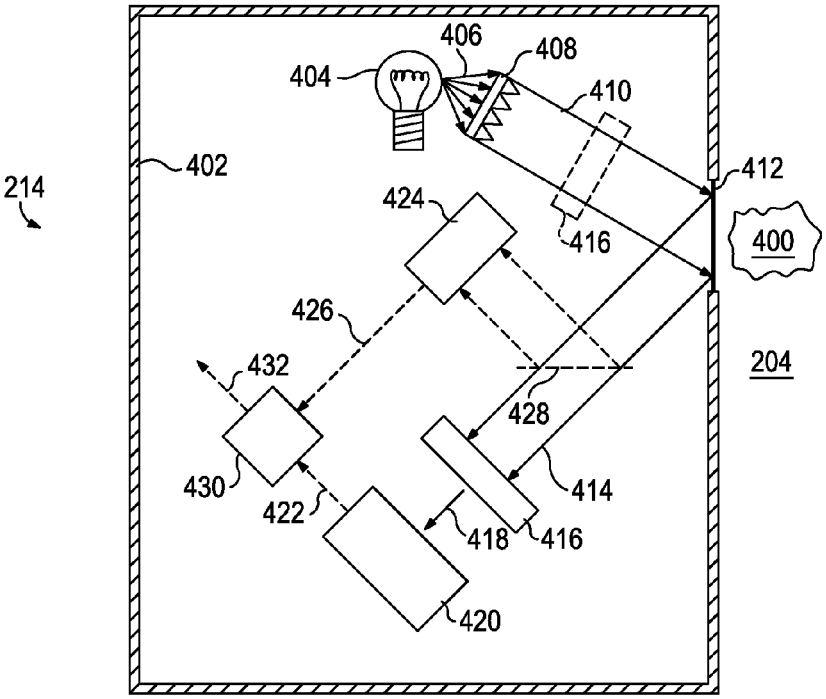
FIG. 4 is a schematic diagram of an exemplary optical computing device, according to one or more embodiments.

Referring now to FIG. 4, with reference to FIGS. 2A and 2B, illustrated is an exemplary schematic view of the optical computing device 214, according to one or more embodiments. Those skilled in the art will readily appreciate that the optical computing device 214, and its components described below, are not necessarily drawn to scale nor, strictly speaking, depicted as optically correct as understood by those skilled in optics. Instead, FIG. 4 is merely illustrative in nature and used generally herein in order to supplement understanding of the description of the various exemplary embodiments. Nonetheless, while FIG. 4 may not be optically accurate, the conceptual interpretations depicted therein accurately reflect the exemplary nature of the various embodiments disclosed.

As briefly described above, the optical computing device 214 may be arranged or otherwise configured to determine a particular characteristic of a substance 400 within the flow path 204 of the work string 114 or the downhole tool 126 (FIGS. 2A and 2B). In some embodiments, the substance 400 may be a fluid and the optical computing device 214 may be configured to detect a characteristic of the fluid within the flow path 204. In other embodiments, however, the substance 400 may be a wellbore projectile within the flow path 204 such as, but not limited to, a ball, dart, plug, and the optical computing device 214 may be configured to detect a characteristic of such projectiles. In such applications, the optical computing device 214 may be configured to detect a color or combination of colors, porosity, density, chemical composition, emissivity, reflectivity, speed, combinations thereof, or any other characteristic of the wellbore projectile to determine whether it has reached the location of the optical computing device 214.

As illustrated, the optical computing device 214 may be housed within a casing or housing 402 configured to substantially protect the internal components of the device 214 from damage or contamination from the substance 400 or any other substance within the flow path 204. In some embodiments, the housing 402 may operate to mechanically couple the device 214 to the flow path 204 with, for example, mechanical fasteners, brazing or welding techniques, adhesives, magnets, combinations thereof, or the like. The housing 402 may be designed to withstand the pressures that may be experienced downhole and thereby provide a fluid tight seal against external contamination.

The device 214 may include an electromagnetic radiation source 404 configured to emit or otherwise generate electromagnetic radiation 406. The electromagnetic radiation source 404 may be any device capable of emitting or generating electromagnetic radiation, as defined herein. For example, the electromagnetic radiation source 404 may be a light bulb, a light emitting diode (LED), a laser, a blackbody, a photonic crystal, an X-Ray source, combinations thereof, or the like. In some embodiments, a lens 408 may be configured to collect or otherwise receive the electromagnetic radiation 406 and direct a beam 410 of electromagnetic radiation 406 toward a location for sampling or otherwise monitoring the substance 400. The lens 408 may be any type of optical device configured to convey the electromagnetic radiation 406 as desired and may include, for example, a normal lens, a Fresnel lens, a diffractive optical element, a holographic graphical element, a mirror (e.g., a focusing mirror), a type of collimator, or any other electromagnetic radiation transmitting device known to those skilled in art. In other embodiments, the lens 408 may be omitted from the device 214 and the electromagnetic radiation 406 may instead be directed toward the substance 400 directly from the electromagnetic radiation source 404.

In one or more embodiments, the device 214 may also include a sampling window 412 arranged adjacent to or otherwise in contact with the flow path 204 on one side for detection purposes. The sampling window 412 may be made from a variety of transparent, rigid or semi-rigid materials that are configured to allow transmission of the electromagnetic radiation 406 therethrough. For example, the sampling window 412 may be made of, but is not limited to, glasses, plastics, semi-conductors, crystalline materials, polycrystalline materials, hot or cold-pressed powders, combinations thereof, or the like.

After passing through the sampling window 412, the electromagnetic radiation 406 impinges upon and optically interacts with the substance 400 in the flow path 204. As a result, optically interacted radiation 414 is generated by and reflected from the substance 400. Those skilled in the art, however, will readily recognize that alternative variations of the device 214 may allow the optically interacted radiation 414 to be generated by being transmitted, scattered, diffracted, absorbed, emitted, or re-radiated by and/or from the substance 400, without departing from the scope of the disclosure.

The optically interacted radiation 414 generated by the interaction with the substance 400 may be directed to or otherwise be received by an ICE 416 arranged within the device 214. The ICE 416 may be a spectral component substantially similar to the ICE 300 described above with reference to FIG. 3. Accordingly, in operation the ICE 416 may be configured to receive the optically interacted radiation 414 and produce modified electromagnetic radiation 418 corresponding to a particular characteristic of the substance 400. In particular, the modified electromagnetic radiation 418 is electromagnetic radiation that has optically interacted with the ICE 416, whereby an approximate mimicking of the regression vector corresponding to the characteristic of interest is obtained.

It should be noted that, while FIG. 4 depicts the ICE 416 as receiving reflected electromagnetic radiation from the substance 400, the ICE 416 may be arranged at any point along the optical train of the device 214, without departing from the scope of the disclosure. For example, in one or more embodiments, the ICE 416 (as shown in dashed) may be arranged within the optical train prior to the sampling window 412 and equally obtain substantially the same results. In other embodiments, the sampling window 412 may serve a dual purpose as both a transmission window and the ICE 416 (i.e., a spectral component). In yet other embodiments, the ICE 416 may generate the modified electromagnetic radiation 418 through reflection, instead of transmission therethrough.

Moreover, while only one ICE 416 is shown in the device 214, embodiments are contemplated herein which include the use of two or more ICE components in the device 214 in order to monitor more than one characteristic of interest at a time. In such embodiments, various configurations for multiple ICE components can be used, where each ICE component is configured to detect a particular and/or distinct characteristic of interest. In some embodiments, the characteristic can be analyzed sequentially using the multiple ICE components that are provided a single beam of electromagnetic radiation being reflected from or transmitted through the substance 400. In some embodiments, multiple ICE components can be arranged on a rotating disc where the individual ICE components are only exposed to the beam of electromagnetic radiation for a short time. Advantages of this approach can include the ability to analyze multiple characteristics of the substance 400 using a single optical computing device and the opportunity to assay additional characteristics simply by adding additional ICE components to the rotating disc. These optional embodiments employing two or more ICE components are further described in co-pending U.S. patent application Ser. Nos. 13/456,264, 13/456,405, 13/456,302, and 13/456,327, the contents of which are hereby incorporated by reference in their entireties.

In other embodiments, multiple optical computing devices 214 can be used at a single location (or at least in close proximity) along the flow path 204, where each optical computing device 214 contains a unique ICE component that is configured to detect a particular characteristic of interest.

Each optical computing device 214 can be coupled to a corresponding detector or detector array that is configured to detect and analyze an output of electromagnetic radiation from the respective optical computing device 214. Parallel configurations of optical computing devices 214 can be particularly beneficial for applications that require low power inputs and/or no moving parts.

The modified electromagnetic radiation 418 generated by the ICE 416 may subsequently be conveyed to a detector 420 for quantification of the signal. The detector 420 may be any device capable of detecting electromagnetic radiation, and may be generally characterized as an optical transducer. In some embodiments, the detector 420 may be, but is not limited to, a thermal detector such as a thermopile or photoacoustic detector, a semiconductor detector, a piezoelectric detector, a charge coupled device (CCD) detector, a video or array detector, a split detector, a photon detector (such as a photomultiplier tube), photodiodes, combinations thereof, or the like, or other detectors known to those skilled in the art.

In some embodiments, the detector 420 may be configured to produce an output signal 422 in real-time or near real-time in the form of a voltage (or current) that corresponds to the particular characteristic of interest in the substance 400. The voltage returned by the detector 420 is essentially the dot product of the optical interaction of the optically interacted radiation 414 with the respective ICE 416 as a function of the concentration of the characteristic of interest of the substance 400. As such, the output signal 422 produced by the detector 420 and the concentration of the characteristic of interest in the substance 400 may be related, for example, directly proportional. In other embodiments, however, the relationship may correspond to a polynomial function, an exponential function, a logarithmic function, and/or a combination thereof.

In some embodiments, the device 214 may include a second detector 424, which may be similar to the first detector 420 in that it may be any device capable of detecting electromagnetic radiation. The second detector 424 may be used to detect radiating deviations stemming from the electromagnetic radiation source 404. Undesirable radiating deviations can occur in the intensity of the electromagnetic radiation 406 due to a wide variety of reasons and potentially causing various negative effects on the device 214. These negative effects can be particularly detrimental for measurements taken over a period of time. In some embodiments, radiating deviations can occur as a result of a build-up of film or material on the sampling window 412 which has the effect of reducing the amount and quality of light ultimately reaching the first detector 420. Without proper compensation, such radiating deviations could result in false readings and the output signal 422 would no longer be primarily or accurately related to the characteristic of interest.

To compensate for these types of undesirable effects, the second detector 424 may be configured to generate a compensating signal 426 generally indicative of the radiating deviations of the electromagnetic radiation source 404, and thereby normalize the output signal 422 generated by the first detector 420. As illustrated, the second detector 424 may be configured to receive a portion of the optically interacted radiation 414 via a beamsplitter 428 in order to detect the radiating deviations. In other embodiments, however, the second detector 424 may be arranged to receive electromagnetic radiation from any portion of the optical train in the device 214 in order to detect the radiating deviations, without departing from the scope of the disclosure.

In some applications, the output signal 422 and the compensating signal 426 may be conveyed to or otherwise received by a signal processor 430 communicably coupled to both the detectors 420, 424. The signal processor 430 may be a computer including a non-transitory machine-readable medium, and may be configured or otherwise programmed to computationally combine the compensating signal 426 with the output signal 422 in order to normalize the output signal 422 in view of any radiating deviations detected by the second detector 424. In some embodiments, computationally combining the output and compensating signals 422, 426 may entail computing a ratio of the two signals 422, 426.

In real-time or near real-time, the signal processor 430 may be configured to determine or otherwise calculate the concentration or magnitude of the characteristic of interest in the substance 400. In some embodiments, the signal processor 430 may be programmed to recognize whether the detected concentration of the characteristic of interest is within or without a predetermined or preprogrammed range for its intended purpose as used with the downhole tool 126. For example, the signal processor 430 may be programmed such that when the concentration of the characteristic of interest remains below a minimum predetermined concentration, the signal processor 430 does not act. In contrast, when the concentration of the characteristic of interest reaches or otherwise surpasses the minimum predetermined concentration of the characteristic of interest, the signal processor 430 may be configured to send a command signal 432 to the actuation device 212 (FIGS. 2A and 2B) in order to cause the downhole tool 126 to act. As briefly described above, the command signal 432 may be conveyed via the communication line 216, for example.

Those skilled in the art will readily recognize the several advantages that the disclosed systems and methods may provide. For example, referring again to FIGS. 2A and 2B, with continued reference to FIG. 4, in at least one embodiment, a particular substance 400 (FIG. 4) or concentration of the substance 400 may be introduced into the flow path 204 and conveyed (e.g., pumped) to the downhole tool 126. In some embodiments, the substance 400 may be introduced into the flowpath 204 at the surface 104 (FIG. 1). In other embodiments, the substance 400 may be introduced into the flow path 204 at any intermediate point along the wellbore 106, such as from the formation 108 itself or any other pay zone defined along the wellbore 106. For instance, the substance 400 may equally include a fluid or material not purposefully introduced into the wellbore 106, but may instead include naturally emanating substances or fluids, such as produced water, fracturing fluid flowback, hydrocarbon seepage, combinations thereof, and the like. Once the optical computing device 214 detects the characteristic of the substance 400, or a predetermined concentration thereof, it may be configured to send the command signal 432 to the actuation device 212 in order to trigger the actuation of a corresponding downhole tool 126. In the illustrated embodiment, actuation of the actuation device 212 may move the sleeve 210 either to its open or closed configurations.

In some embodiments, the substance 400 conveyed to the downhole tool may be any fluid, as generally described herein, or any chemical composition flowing or otherwise present within the fluid. For example, the substance 400 may include, for example, a cement, a drilling fluid, a treatment fluid, a gravel pack slurry, a fracture slurry, a completion fluid, combinations thereof, or the like. In other embodiments, the substance 400 may be a fluid with sand (i.e., silica or $SiO_2$) or other solid particulates entrained therein. Once the optical computing device 214 detects a predetermined concentration of the sand or other solid particulates in the fluid, the command signal 432 may be properly sent to actuate the downhole tool 126.

In other embodiments, the substance 400 may be a spacer fluid or a "pill" injected into the flow path 204 around such fluids as a cement, a drilling fluid, a treatment fluid, a gravel pack slurry, a fracture slurry, a completion fluid, combinations thereof, or the like. The optical computing device 214 may be configured to detect one or more characteristics of such a spacer fluid. In at least one embodiment, the characteristic may be a predetermined concentration of the spacer fluid. Exemplary spacer fluids include, but are not limited to water, brines, viscosified brines, viscosified water, weighted and viscosified oil-based or water-based drilling fluids, weighted and viscosified brines, oils, combinations thereof, and the like. In some embodiments, the spacer fluid may be formed of a fluid having certain physical properties such as, but not limited to, surface tension, density, opacity, capacitance, conductivity, magnetism, a particular solids content, salinity, a particular oil/water ratio, a particular refractive index, a chemical concentration, a spectral fingerprint, combinations thereof, or the like.

In some embodiments, the optical computing device 214 may be configured to delay the transmission of the command signal 432 for a predetermined period of time. In other embodiments, the optical computing device 214 may be configured such that it must detect or otherwise ascertain a certain concentration of a characteristic for a predetermined period of time before the command signal 432 is sent. In yet other embodiments, the optical computing device 214 may be configured or otherwise programmed to detect a particular combination or pattern of characteristics prior to transmitting the command signal 432.

Referring again to FIG. 1, with continued reference to the remaining figures, embodiments are contemplated herein where a substance 400 is conveyed into the work string 114 in order to communicate or otherwise interact with a particular downhole tool 126 and otherwise bypass interaction with the remaining downhole tools 126. For example, the optical computing device 214 of the third downhole tool 126*c* may be configured to detect a particular characteristic of the substance 400 that may be undetectable or otherwise unmonitored by the optical computing devices 214 of the first and second downhole tools 126*a,b*. As a result, the substance 400 may be conveyed into the work string 114 past the first and second downhole tools 126*a* and 126*b* without either tool reacting thereto, but the third downhole tool 126*c* may be actuated or otherwise triggered once its corresponding optical computing device 214 detects the particular characteristic of the substance 400 or a specific concentration thereof.

In such embodiments, the substance 400 may be any fluid described herein, for example, or a solid object such as a plug, dart, or ball conveyed downhole. As will be appreciated, this may prove advantageous in being able to intelligently operate the various downhole tools 126*a-c*. For instance, such embodiments may be useful in intelligently treating the surrounding formation 108 through active detection of various treatment fluids. Depending on certain characteristics of the treatment fluids (e.g., concentration, chemical composition, etc), each downhole tool 126*a-c* may be adjusted accordingly.

In at least one embodiment, the optical computing device 214 of each of the downhole tools 126*a-c* may be configured to detect water, such as water that may be derived from the subterranean formation 108. Once the corresponding optical computing device 214 of at least one of the downhole tools 126*a-c* detects a predetermined concentration of water in its adjacent flow path 204, the command signal 432 may be properly sent to actuate the corresponding downhole tool 126*a-c*. Such an embodiment may prove advantageous during production operations where the subterranean formation 108 may begin to produce water into the work string 114 via one or more pay zones instead of hydrocarbons. Once an optical computing device 214 of a downhole tool 126*a-c* detects the influx of water into the flow path 204, the command signal 432 may direct the actuation device 212 to close the corresponding sleeve 210, thereby occluding the flow ports 208 of that particular downhole tool 126 and preventing any further water production from that pay zone.

As can be appreciated, this may allow a well operator to intelligently produce multiple pay zones of the subterranean formation 108, thereby increasing production efficiency and otherwise extending the life of a well. As briefly mentioned above, the optical computing device 214 in such an embodiment may be configured to delay the transmission of the command signal 432 for a predetermined period of time. In other embodiments, the optical computing device 214 may be configured such that it must detect or otherwise ascertain a certain concentration of a characteristic for a predetermined period of time before the command signal 432 is sent. In yet other embodiments, the optical computing device 214 may be configured or otherwise programmed to detect a particular combination or pattern of characteristics prior to transmitting the command signal 432. In ever further embodiments, the optical computing device 214 may be configured with a time delay before any measurements are taken, or may be configured to coordinate multiple measurements before deciding whether to trigger the actuation device 212.

In other embodiments, the optical computing device 214 of each of the downhole tools 126*a-c* may be configured to detect the concentration and/or flow rate of one or more hydrocarbons being produced from each corresponding pay zone. Such measurement statistics may be conveyed to the surface 104 for consideration by a well operator. Knowing the concentration and flow rate of hydrocarbons being produced at each pay zone may help the operator to strategically balance the hydrocarbon production from each pay zone individually. For example, in at least one embodiment, the actuation device 212 of each downhole tool 126*a-c* may be configured to selectively move its corresponding sleeve 210 to a intermediate location between the open and closed configurations, thereby allowing effectively choking the fluid flow therethrough by partially occluding the corresponding flow ports 208. As a result, production efficiency may be increased and the life of the well may be prolonged.

It is recognized that the various embodiments herein directed to computer control and/or artificial neural networks, including various blocks, modules, elements, components, methods, and algorithms, can be implemented using computer hardware, software, combinations thereof, and the like. To illustrate this interchangeability of hardware and software, various illustrative blocks, modules, elements, components, methods and algorithms have been described generally in terms of their functionality. Whether such functionality is implemented as hardware or software will depend upon the particular application and any imposed design constraints. For at least this reason, it is to be recognized that one of ordinary skill in the art can implement the described functionality in a variety of ways for a particular application. Further, various components and blocks can be arranged in a different order or partitioned differently, for example, without departing from the scope of the embodiments expressly described.

Computer hardware used to implement the various illustrative blocks, modules, elements, components, methods, and algorithms described herein can include a processor configured to execute one or more sequences of instructions, programming stances, or code stored on a non-transitory, computer-readable medium. The processor can be, for example, a general purpose microprocessor, a microcontroller, a digital signal processor, an application specific integrated circuit, a field programmable gate array, a programmable logic device, a controller, a state machine, a gated logic, discrete hardware components, an artificial neural network, or any like suitable entity that can perform calculations or other manipulations of data. In some embodiments, computer hardware can further include elements such as, for example, a memory (e.g., random access memory (RAM), flash memory, read only memory (ROM), programmable read only memory (PROM), erasable read only memory (EPROM)), registers, hard disks, removable disks, CD-ROMS, DVDs, or any other like suitable storage device or medium.

Executable sequences described herein can be implemented with one or more sequences of code contained in a memory. In some embodiments, such code can be read into the memory from another machine-readable medium. Execution of the sequences of instructions contained in the memory can cause a processor to perform the process steps described herein. One or more processors in a multi-processing arrangement can also be employed to execute instruction sequences in the memory. In addition, hard-wired circuitry can be used in place of or in combination with software instructions to implement various embodiments described herein. Thus, the present embodiments are not limited to any specific combination of hardware and/or software.

As used herein, a machine-readable medium will refer to any non-transitory medium that directly or indirectly provides instructions to a processor for execution. A machine-readable medium can take on many forms including, for example, non-volatile media, volatile media, and transmission media. Non-volatile media can include, for example, optical and magnetic disks. Volatile media can include, for example, dynamic memory. Transmission media can include, for example, coaxial cables, wire, fiber optics, and wires that form a bus. Common forms of machine-readable media can include, for example, floppy disks, flexible disks, hard disks, magnetic tapes, other like magnetic media, CD-ROMs, DVDs, other like optical media, punch cards, paper tapes and like physical media with patterned holes, RAM, ROM, PROM, EPROM and flash EPROM.

It should also be noted that the various drawings provided herein are not necessarily drawn to scale nor are they, strictly speaking, depicted as optically correct as understood by those skilled in optics. Instead, the drawings are merely illustrative in nature and used generally herein in order to supplement understanding of the systems and methods provided herein. Indeed, while the drawings may not be optically accurate, the conceptual interpretations depicted therein accurately reflect the exemplary nature of the various embodiments disclosed.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

The invention claimed is:

1. A well system, comprising:

a work string providing a flow path therein;

a substance introduced into the flow path from a surface location;

a downhole tool coupled to the work string;

an actuation device operatively coupled to the downhole tool to act on the downhole tool upon receiving a command signal such that the downhole tool performs a predetermined action; and an optical computing device communicably coupled to the actuation device and including at least one integrated computational element having a plurality of layers that optically interact with the substance to generate optically interacted light, wherein the optical computing device detects a characteristic of the substance in the flow path and sends the command signal to the actuation device to trigger actuation of the actuation device upon detecting the characteristic.

2. The well system of claim 1, wherein the optical computing device further comprises at least one detector arranged to receive the optically interacted light and generate an output signal corresponding to the characteristic of the substance.

3. The well system of claim 1, wherein the characteristic of the substance is at least one of a chemical composition, a phase, an impurity content, a pH level, a viscosity, a density, a total dissolved solids concentration, a salt content, a porosity, an opacity, a bacteria content, a color, and a state of matter.

4. The well system of claim 1, wherein the substance is a fluid.

5. The well system of claim 4, wherein the fluid is selected from the group consisting of a spacer fluid, water, brines, hydrocarbons, oil, petrochemical products, acids, surfactants, biocides, bleaches, corrosion inhibitors, foamers and foaming agents, breakers, scavengers, stabilizers, clarifiers, detergents, a treatment fluid, a fracturing fluid or slurry, a formation fluid, a cement, a drilling fluid, a gravel pack slurry, a completion fluid, air, nitrogen, carbon dioxide, argon, helium, methane, ethane, butane, and other hydrocarbon gases, hydrogen sulfide, and any combination thereof.

6. The well system of claim 4, wherein characteristic is a predetermined concentration of the fluid.

7. The well system of claim 1, wherein the substance is a wellbore projectile and the characteristic is at least one of a color, a porosity, a density, and a chemical composition of the wellbore projectile.

8. The well system of claim 1, wherein the downhole tool comprises a tool selected from the group consisting of a sliding sleeve assembly, a sampling device, a wellbore packer or other wellbore device, setting tools, a valve, a flow restrictor, a fluid sampler, sensors, telemetry devices, monitoring devices, drilling/reaming devices or other well intervention devices, fishing tools, wellbore cleaning devices, injection and cutting devices, conveyance devices, material or fluid delivery devices, logging tools, measuring tools, artificial lifting devices, connectors, and any combination thereof.

9. A method of remotely actuating a downhole tool, comprising:

conveying a substance into a flow path defined in a work string from a surface location, the downhole tool being coupled to the work string;

monitoring the flow path with an optical computing device configured to detect a characteristic of the substance, wherein the optical computing device includes at least one integrated computational element having a plurality of alternating layers;

transmitting a command signal to an actuation device with the optical computing device based on detection of the characteristic of the substance, the actuation device being operatively coupled to the downhole tool; and acting on the downhole tool with the actuation device in response to the command signal such that the downhole tool performs a predetermined action.

10. The method of claim 9, wherein monitoring the flow path with the optical computing device comprises:

optically interacting the plurality of alternating layers of the at least one integrated computational element with the substance to generate optically interacted light;

receiving the optically interacted light with at least one detector; and generating an output signal with the at least one detector corresponding to the characteristic of the substance.

11. The method of claim 9, wherein conveying the substance into the flow path comprises conveying a fluid into the flow path.

12. The method of claim 9, wherein conveying the substance into the flow path comprises conveying a wellbore projectile into the flow path, the characteristic being at least one of a color, a porosity, a density, and a chemical composition of the wellbore projectile.

13. The method of claim 9, further comprising delaying transmission of the command signal for a predetermined period of time following detection of the characteristic of the substance.

14. The method of claim 9, further comprising detecting the characteristic of the substance with the optical computing device for a predetermined period of time before transmitting the command signal to the at least one actuation device.

15. A well system, comprising:

a work string providing a flow path therein;

a substance introduced into the flow path from a surface location;

a sliding sleeve assembly coupled to the work string and having a sleeve movably arranged therein between an open configuration, where fluid communication is allowed between an interior of the work string and an exterior of the work string, and a closed configuration, where fluid communication is prevented between the interior of the work string and the exterior of the work string;

an actuation device operatively coupled to the sliding sleeve assembly and configured to move the sleeve between the open and closed configurations upon receiving a command signal; and an optical computing device communicably coupled to the actuation device and including at least one integrated computational element having a plurality of layers that optically interact with the substance to generate optically interacted light, wherein the optical computing device detects a characteristic of a substance in the flow path and sends the command signal to the actuation device to trigger actuation of the actuation device upon detecting the characteristic.

16. The well system of claim 15, wherein the optical computing device comprises at least one detector arranged to receive the optically interacted light and generate an output signal corresponding to the characteristic of the substance.

17. The well system of claim 15, wherein the characteristic of the substance is at least one of a chemical composition, a phase, an impurity content, a pH level, a viscosity, a density, a total dissolved solids concentration, a salt content, a porosity, an opacity, a bacteria content, a color, and a state of matter.

18. The well system of claim 15, wherein the substance is a fluid selected from the group consisting of a spacer fluid, water, brines, hydrocarbons, oil, petrochemical products, acids, surfactants, biocides, bleaches, corrosion inhibitors, foamers and foaming agents, breakers, scavengers, stabilizers, clarifiers, detergents, a treatment fluid, a fracturing fluid or slurry, a formation fluid, a cement, a drilling fluid, a gravel pack slurry, a completion fluid, air, nitrogen, carbon dioxide, argon, helium, methane, ethane, butane, and other hydrocarbon gases, hydrogen sulfide, and any combination thereof.

19. The well system of claim 18, wherein the characteristic is a predetermined concentration of the fluid.

20. The well system of claim 18, wherein the characteristic is a concentration of solid particulates entrained in the fluid.

21. The well system of claim 15, wherein the substance is a wellbore projectile and the characteristic is at least one of a color, a porosity, a density, and a chemical composition of the wellbore projectile.

22. A method of remotely actuating a sliding sleeve assembly, comprising:

conveying a substance into a flow path defined in a work string from a surface location, the sliding sleeve assembly being coupled to the work string and having a sleeve movably arranged therein;

monitoring the flow path with an optical computing device configured to detect a characteristic of the substance, wherein the optical computing device includes at least one integrated computational element having a plurality of alternating layers;

transmitting a command signal to an actuation device from the optical computing device based on detection of the characteristic of the substance, the actuation device being operatively coupled to the sliding sleeve assembly; and moving the sleeve with the actuation device in response to the command signal.

23. The method of claim 22, wherein monitoring the flow path with the optical computing device comprises:

optically interacting the plurality of alternating layers of the at least one integrated computational element with the substance to generate optically interacted light;

receiving the optically interacted light with at least one detector; and generating an output signal with the at least one detector corresponding to the characteristic of the substance.

24. The method of claim 22, wherein conveying the substance into the flow path comprises conveying a fluid into the flow path.

25. The method of claim 22, wherein conveying the substance into the flow path comprises conveying a wellbore projectile into the flow path, the characteristic being at least one of a color, a porosity, a density, and a chemical composition of the wellbore projectile.

26. The method of claim 22, wherein moving the sleeve with the actuation device comprises one of moving the sleeve to an open configuration, where fluid communication is allowed between an interior of the work string and an exterior of the work string, and moving the sleeve to a closed configuration, where fluid communication is prevented between the interior of the work string and the exterior of the work string.

* * * * *